United States Patent [19]

Björk

[11] 4,148,210

[45] Apr. 10, 1979

[54] SELF-TIGHTENING PULL CLAMP FOR ATTACHING TO SHEET METAL FLANGES AND THE LIKE

[75] Inventor: Bengt A. Björk, Eskilstuna, Sweden

[73] Assignee: AB Nike Hydraulik

[21] Appl. No.: 823,378

[22] Filed: Aug. 10, 1977

[30] Foreign Application Priority Data

Aug. 17, 1976 [SE] Sweden ..... 7609165

[51] Int. Cl.[2] ..... B21D 1/12; B25B 5/08

[52] U.S. Cl. ..... 72/457; 72/705; 294/116

[58] Field of Search ..... 72/705, 457; 294/116; 269/234; 24/251

[56] References Cited

U.S. PATENT DOCUMENTS

| | | | |
|---|---|---|---|
| 1,556,394 | 10/1925 | Zange | 269/234 |
| 3,276,237 | 10/1966 | Transue | 72/705 X |
| 3,610,022 | 10/1971 | Lincourt | 72/457 |
| 3,696,653 | 10/1972 | Mojelski | 72/705 |
| 3,827,279 | 8/1974 | Buske | 72/705 X |
| 3,955,249 | 5/1976 | Shiozaki | 72/705 X |
| 3,986,746 | 10/1976 | Chartier | 72/705 X |
| 4,037,456 | 7/1977 | Jarman | 72/705 X |

FOREIGN PATENT DOCUMENTS

| | | | |
|---|---|---|---|
| 222495 | 9/1968 | Sweden | 72/705 |

*Primary Examiner*—C. W. Lanham
*Assistant Examiner*—D. M. Gurley
*Attorney, Agent, or Firm*—Pollock, Vande Sande & Priddy

[57] ABSTRACT

A pull clamp is provided for attaching to sheet metal flanges for transmission of pulling forces to the sheet metal, particularly in collision repair operations. The clamp comprises a pair of opposed clamping jaws adapted to be tightened against each other by bolts and have at one end opposite clamping surfaces for engagement with the sheet metal flange, the jaws furthermore enclosing a connecting member for coupling to a pulling means, said member including a conical wedge element for exerting a spreading-apart action of the inner surfaces of the jaws and hence through the bolts increase the clamping force between the clamping surfaces of the jaws in proportion to the pull of the pulling means. According to the invention the wedge element is constituted by an annular body with conical end surfaces and a control opening therethrough accommodating a pin which centrally extends transversely through both jaws with great radial clearance in holes in said jaws and outwardly of the latter carrying a pivotable yoke for coupling to the pulling means.

10 Claims, 3 Drawing Figures

SELF-TIGHTENING PULL CLAMP FOR ATTACHING TO SHEET METAL FLANGES AND THE LIKE

BACKGROUND OF THE INVENTION

The present invention refers to a pull clamp for attaching to sheet metal flanges, folds and the like for transmission of pulling forces to a piece of sheet metal, particularly in collision repair or alignment operations on damaged vehicle bodies etc. The clamp comprises two opposed clamping jaws which are tightened against each other by bolts. One end of the clamp includes opposite clamping surfaces for engagement with the sheet metal flange or fold, wherein the jaws enclose a connecting member for coupling to a pulling means, with the member including a conical wedge element for exerting a spreading-apart action on the inner surfaces of the jaws to increase the clamping force between the clamping surfaces of the jaws in proportion to the pull of the pulling means.

Pull clamps are previously known for transmitting pulling forces from a pulling means such as an hydraulic power cylinder to the edge of one or more sheet metal pieces or to a sheet metal fold. It has turned out to be difficult, however, to obtain a reliable attachment to the sheet metal edge through only the clamping force from bolts positioned between the jaws, particularly for greater pulling forces. Various design suggestions therefore have been made for allowing a greater or smaller increase of the clamping force at the clamping surfaces of the jaws by means of the applied pulling force.

Initially said designs operated satisfactorily only when the pulling force acted in the plane of the sheet metal edge or fold and at right angles to the longitudinal direction thereof. When in other oblique directions to the longitudinal direction, the pulling force still had a tendency to pull off the clamps from their engagement with the sheet metal. An attempt to eliminate this drawback of known pull clamps has been made in a structure disclosed in the Swedish patent specification No. 222,495. While the pull clamp described therein has been able to stand pulling forces within a smaller angle to a perpendicular to the sheet metal edge or fold, as attempt at greater angles to the perpendicular the connecting member has resulted in an opposite action along the portion of the clamping surfaces closest thereto, namely a reduction of the clamping force between said surfaces. There is, however, an ever increasing demand for a pull clamp, particularly in today's collision repair equipments, which allows the application of pulling forces within a range from at right angle to the longitudinal direction of the fold to parallel thereto without impairing the clamping force between the clamping surfaces at any portion thereof.

OBJECT AND SUMMARY OF THE INVENTION

A object of the present invention is to eliminate the above-shortcomings in the known pull clamps and to provide a clamp which can be used within a range from right angle to parallel to the fold. According to the present invention this object is achieved substantially through a wedge element including an annular body with conical end surfaces and a central opening accommodating a pin which centrally extends transversely through both jaws with great radial clearance in holes in said jaws and outwardly of the latter and carrying a pivotable yoke for coupling to the pulling means.

BRIEF DESCRIPTION OF THE DRAWINGS

By way of examples, the invention will be further described below with reference to the accompanying drawings, in which.

DETAILED DESCRIPTION OF THE PREFERRED EMBODIMENT

Figure 1:
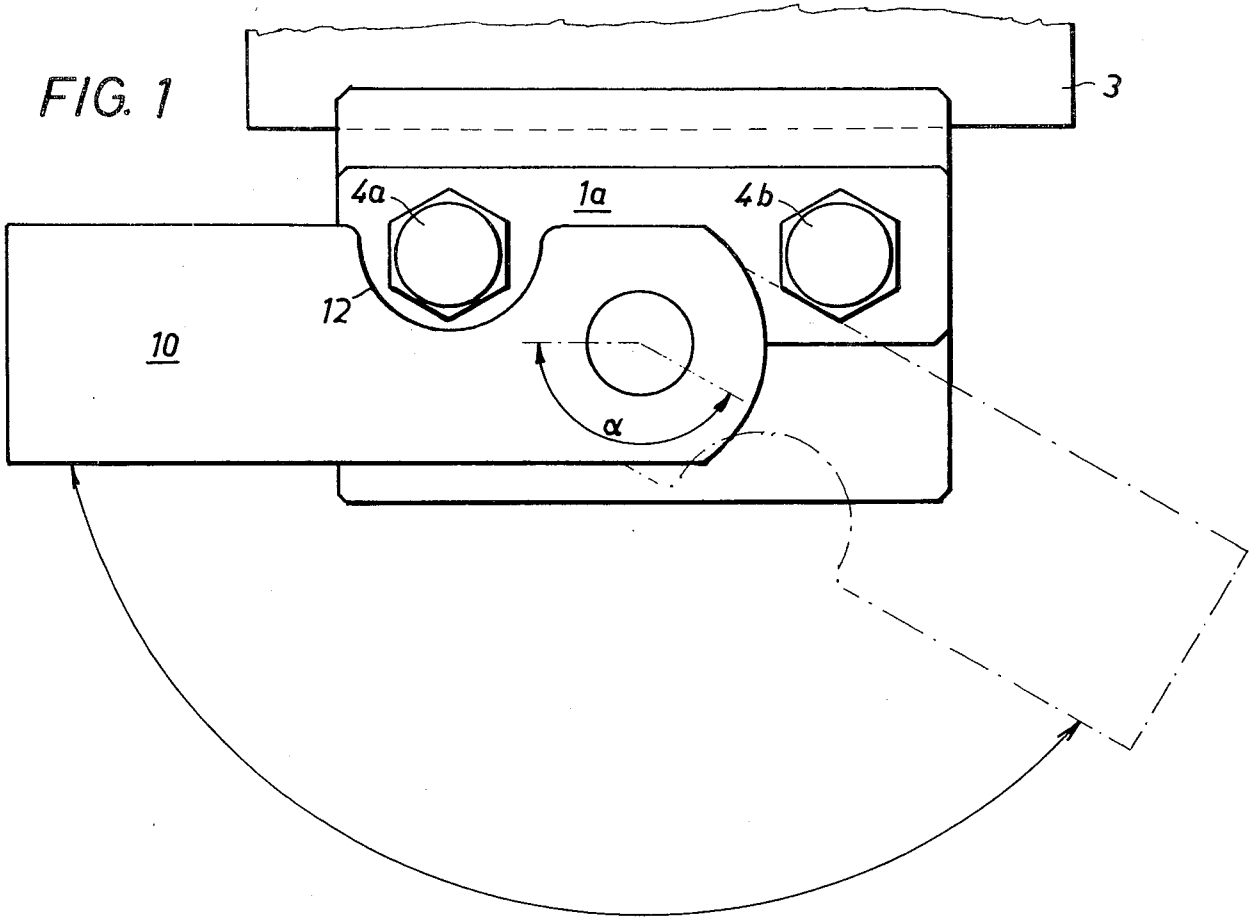
FIG. 1 shows a side elevational view of a pull clamp according to a preferred embodiment.

As shown in the drawings, the pull clamp comprises two opposed clamping jaws 1*a*, 1*b*, which at one of their ends are formed with oppositely located clamping surfaces 2*a*, 2*b*. The pull clamp is adapted to be clamped by means of said clamping surfaces 2*a*, 2*b* to a sheet metal edge or fold 3 by tightening the clamping jaws 1*a*, 1*b* against each other as known per se by means of bolts 4. The clamping jaws 1*a*, 1*b* also are connected to a connecting member including a wedge element and are adaptable for coupling to a pulling means (not illustrated) such as an hydraulic power cylinder for pull alignment purposes.

According to the invention the wedge element comprises an annular body 5 with frustoconical end surfaces 6*a*, 6*b* directed axially outwardly. Through the central opening 7 of said annular body 5 extends a pin 8, preferably with a free play fit.

Figure 2:
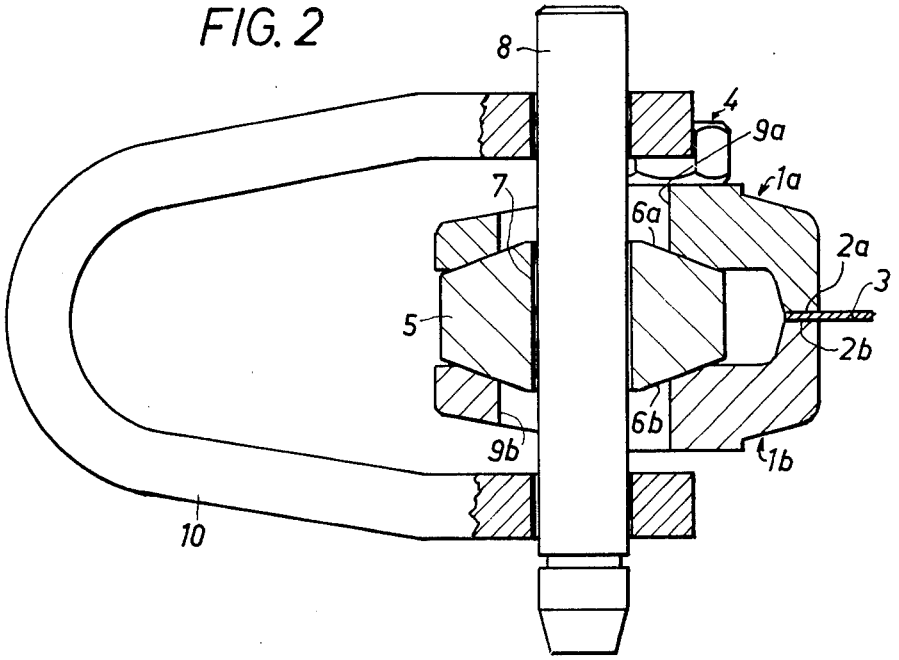
FIGS. 2 and 3 illustrate, partially in section, end views of the pull clamp in unloaded and loaded condition, respectively.

Spaced from the end of the clamping jaws 1*a*, 1*b* including the clamping surfaces 2*a*, 2*b* and extending centrally through the jaws are opposite transverse holes 9*a*, 9*b* therein. The pin 8 extends through said holes 9*a*, 9*b* and protrudes with its ends beyond the outer surface of said clampng jaws 1*a*, 1*b* and carries a pivotable yoke 10 for coupling to the pulling means (not illustrated). The transverse holes 9*a*, 9*b* in the jaws have a substantially greater diameter than the pin 8 so that said pin will have a great clearance in said holes for a purpose which will be further described below. Preferably the edge of the holes 9*a*, 9*b* at the inner surface of the jaws 1*a*, 1*b* have a bevel 11*a*, 11*b* of substantially the same apex angle as the end surfaces 6*a*, 6*b* of the annular body 5. Under all circumstances the thickness of the body 5 or the axial distance between the operative portions of the two conical end surfaces 6*a*, 6*b* of the body 5 are to be selected such that the inner surfaces of the jaws 1*a*, 1*b* are kept substantially in parallelism in the unloaded initial position before pulling, i.e. with the jaws 1*a*, 1*b* clamped to the sheet metal edge 3 and with the pin 8 and thus the body 5 centered in the holes 9*a*, 9*b*. This unloaded condition is more clearly evident in FIG. 2.

Figure 3:
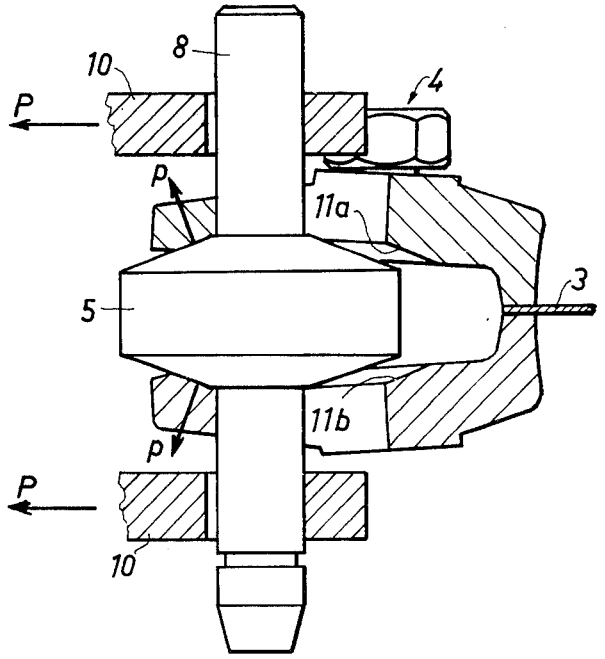

The pull clamp according to the invention operates as will be in conjunction with FIG. 3. When applying a pull force P to the yoke 10 by means of the pulling means (not illustrated) the force will be transferred through the conical end surfaces 6*a*, 6*b* of the annular body 5 and to the engaging inner surfaces of the clamping jaws 1*a*, 1*b*, with a resulting force p pressing the jaws against the sheet metal fold 3. The conical shape of the end surfaces 6*a*, 6*b* provides a simultaneous spreading-apart action on the inner surfaces of the clamping jaws at the portion thereof lying closest to the pulling means. The force also creates a lever action or a moment on the bolts 4 which increases the clamping force between the clamping surfaces 2a, 2b which engages the sheet metal fold 3. According to the preferred embodiment, there are two bolts for tightening the jaws 1a, 1b designated 4a, 4b and located on either side of the pin holes 9a, 9b. Because of this construction pulling forces in the plane of the sheet metal fold which are directed obliquely to the perpendicular to the fold or even parallel to the latter will not reduce the clamping force between the clamping surfaces 2a, 2b at the adjacent portion thereof.

Also pulling forces directed obliquely to the plane of the sheet metal fold 3 will be advantageously transferred, i.e., with accompanying increased tightening force between the clamping surface instead of a loosening action as in prior pull clamp structures.

Another advantage of the pull clamp according to the present invention is that the maximum spacing of the conical end surfaces 6a, 6b, i.e. the distance between their internal periphery at the edge of the opening 7, can be selected so as to correspond to the maximum allowable spreading-apart of the jaws 1a, 1b for eliminating rupture of the latter, which otherwise has been common in prior jaws of similar kind. At such maximum spreading-apart of the clamping jaws 1a, 1b the pin 8 comes into engagement with the wall of the holes 9a, 9b and will then assist in taking up the excessive pulling force and transfer the same to the jaws.

Since the pull clamp can be used in pulling directions at right angles to the longitudinal direction of the sheet metal edge or fold 3 as well as parallel to the latter and in all intermediate directions, the coupling yoke 10 is made with a necessary recess 12 or has a corresponding asymmetric shape for accommodating the head of one of the bolts 4a. Furthermore the pin 8 is easily detachably mounted by means of some known kind of spring clip so as to be easily removed for turning of the yoke 10 when the pulling direction is to be reversed. Because of this reversibility the yoke 10 can be utilized for pulling directions within a pivotal angle $\alpha$ of more than 150° and, after turning, totally more than 180°.

I claim:

1. A self-tightening clamp assembly for providing clamping engagement with sheet metal flanges and the like, and comprising:

first and second separate clamping jaw members each having a first end portion extending substantially parallel to one another with said first end portions being selectively positioned on opposite sides of said flange;

at least two spaced fastener means interconnecting said first and second jaw members for selectively drawing said first end portions into abutting contact with said flange;

self-tightening actuator assembly positioned between said first and second clamping jaw members and slidably engageable with opposed inner surfaces formed on each of said jaw members, said actuator having an aperture extending completely therethrough;

a pair of further apertures extending through said first and second jaw members, each of said further apertures having a diameter larger than a diameter of said aperture formed through sad actuator assembly, with all of said apertures being aligned with one another;

connecting means extending through said aligned apertures for sliding said actuator assembly substantially away from said first end portions of said jaw members through an arc of at least 150° as measured about said jaw members; and wedge means formed along portions of opposed inner jaw surfaces and abutting surfaces of said actuator assembly for progressively increasing the clamping pressure of said first end portions against said flange responsive to the distance said actuator assembly moves.

2. An apparatus according to claim 1, wherein each of said fastener means comprises a bolt member extending through a pair of aligned apertures formed in said jaw members for tightening said jaws against one another.

3. An apparatus according to claim 1, wherein each of said fastener means is positioned an equal distance from said front end portions of said jaw members.

4. An apparatus according to claim 1, wherein said actuator assembly comprises an annular-shaped member with said aperture being centrally disposed therethrough.

5. An apparatus according to claim 1 wherein said connecting means comprises a shaft-like member extending through said aligned apertures formed through said first and second clamping jaw members and said actuator assembly.

6. An apparatus according to claim 5, wherein movement of said shaft and actuator is positively limited by engagement of said shaft with walls forming the apertures in said clamping jaws.

7. An apparatus according to claim 5, wherein said connecting means further comprises a yoke-like member attached to opposite ends of said shaft member for sliding said shaft and said actuator relative to said first and second clamping jaw members.

8. An apparatus according to claim 1, wherein said wedge means comprises tapering each of the opposed actuator sides from a central portion toward opposite edge portions of said actuator, said wedge means also comprises bevelling each of the opposed inner surfaces of said clamping jaws to provide a complementary tapered shape abutting said tapered actuator, wherein movement of said actuator progressively wedges apart the engaging inner surfaces of said clamping jaws to progressively tighten the first end portions of said jaw members against said flange.

9. An apparatus according to claim 1, wherein said actuator assembly includes a pair of frustoconically shaped end portions extending from opposite sides of said aperture, said actuator assembly further being positioned substantially between said first and second fastener means, whereby each of said fastener means functions as a fulcrum to transmit clamping pressure along the entire engaging surfaces of said first end portions responsive to movement of said actuator assembly.

10. An apparatus according to claim 9, wherein the edge portions of the apertures formed through said jaw members are bevelled at substantially the same apex angle as the included surfaces formed on said actuator assembly.

* * * * *